United States Patent [19]

Goldhammer

[11] Patent Number: 4,520,722

[45] Date of Patent: Jun. 4, 1985

[54] SAFETY AND WARNING DEVICES FOR BALING PRESSES

[76] Inventor: Albert Goldhammer, Zum Hecht 46, 7770 Überlingen, Fed. Rep. of Germany

[21] Appl. No.: 578,843

[22] Filed: Feb. 10, 1984

Related U.S. Application Data

[62] Division of Ser. No. 198,163, Oct. 17, 1980, Pat. No. 4,430,934.

[30] Foreign Application Priority Data

Oct. 18, 1979 [DE] Fed. Rep. of Germany ..... 2942219
Oct. 18, 1979 [DE] Fed. Rep. of Germany ..... 2942228

[51] Int. Cl.[3] ..... B30B 1/18
[52] U.S. Cl. ..... 100/99; 100/53; 100/289; 100/295
[58] Field of Search ..... 100/215, 99, 289, 53, 100/229 A, 3, 295; 74/608, 612, 615

[56] References Cited

U.S. PATENT DOCUMENTS 3,601,953 8/1971 Boyd ..... 100/229 A X
4,130,054 12/1978 Tashman ..... 100/229 A X

*Primary Examiner*—Billy J. Wilhite
*Attorney, Agent, or Firm*—Boniard I. Brown

[57] ABSTRACT

A baling press has a filler opening and workpiece in which a press piston is movable between retracted and compressing positions. Elongated flexible warning bands or cords, preferably elastic, are attached to the press piston and engage apparatus on the housing for extension between the piston and an edge of the filler opening to provide warning against inserting material through the filler opening. The engaging apparatus on the housing may comprise a tension arrangement to maintain the warning bands or cords taut at all positions of the piston. The tensioning apparatus may comprise a spring-loaded arrangment or an arrangement wherein the bands or cords extend about one or more rollers and are tensioned by a weight. Only a limited area of the filler opening is covered in order to provide manual access therethrough. The bands or cords may be arranged in crossing or in parallel relation.

26 Claims, 7 Drawing Figures

SAFETY AND WARNING DEVICES FOR BALING PRESSES

RELATED APPLICATIONS

This application is a divisional of co-pending application, Ser. No. 198,163, filed Oct. 17, 1980 now U.S. Pat. No. 4,430,934.

SUMMARY OF THE INVENTION

The invention relates to a safety device in a baling press for switching off the pressing plate drive when the filler lid is opened by means of a switch disposed in the opening path of the filler lid, and to a warning device when the filler lid is opened.

With previously known filler lids it has been found disadvantageous that the filler lid had to be lifted up by physical force in order to be fixed in a more or less stable final position. Moreover, the weight of the filler lid upon closing by physical force had to be damped in order to avoid too great a force on the press housing.

It was also disadvantageous that the switch for the pressing plate drive had only short operating paths.

An object of the present invention is to develop a safety device in a baling press such that irrespective of the amount of wear on the switch, an identical opening angle of the filler lid is always achieved.

A further object of the present invention is to obviate the inconvenient raising and lowering of the filler lid by physical force. The invention is characterized in that the filler lid is coupled, via an angle lever and a set of operating rods, to an energy store and by displacement of the rods the switch is operated.

An essential feature of the present invention is that the filler lid is hinged to an angle lever which is coupled to an energy store at its other end. Thus, relative to the swivel angle of the filler lid, a large operating path for the energy store results since it is attached to the other free end of the angle lever.

In addition to this feature it is essential that the switch is operated by displacement of the set of operating rods which is coupled between the energy store and the free end of the angle lever.

By the attachment of the filler lid to the angle lever and by the arrangement of the set of operating rods together with the energy store and the switch at the other end of the angle lever, a small swivel angle of the filler lid causes a large displacement of the operating rods. Thus, a very finely differentiated switch point is obtained because, for example, a swivel angle of 2° corresponds to a displacement of the operating rods by 10 cm.

Advantages are obtained by the combination of the two said features. The coupling of the filler lid via a set of operating rods to an energy store such that the energy store is tensioned upon closing of the filler lid and is relieved upon opening of the filler lid results in the advantage that the filler lid can be opened substantially without physical force because the necessary opening force is produced by the energy store. Furthermore, the filler lid will no longer fall inadvertently under its own weight onto the press housing because the energy store in closing produces a counter force as it is tensioned by the closing movement.

According to the invention a sensitive, accurately differentiated switch is disposed in the path of the operating rod and the energy store so that switching off of power to the press platen is effected at a predetermined opening angular position of the filler lid, which angle is substantially independent of wear on the lid.

In a preferred embodiment of the present invention, the energy store may be a coiled spring. It may be a traction spring or a compression spring.

In another embodiment the energy store may be a gas pressure spring. In addition to the energy store, further damping means may be used, for example, the connection in parallel of the energy store with a shock absorber. A particularly simple and reliable arrangement results if the switch has as an operating member, a sensing roller which engages a control rod of the operating rods, the said control rod having an angled portion which when the filler lid is closed, lies over the sensing roller.

The type and position of the angle determines the switch point of the switch. Of course, instead of this angle, another type of control may be used, for example, a half-round shaped bend or the like.

Instead of a switch which is operated via a sensing roller, it is also possible to use contactless switches.

It is proposed that the energy store and the switches are no longer disposed on the upper side of the press housing where they are substantially unprotected from dirt and other damage but instead that the energy store and the switch are disposed on the side wall of the press housing. It is proposed that the side wall of the press housing be covered by a covering wall so that a two-shell construction results between which are disposed the switch and the energy store. Thus, the switch is protected from dirt and damage.

In order to obtain a margin of safety in the baling press against incorrect loading which could lead to the machine breaking down, a further subject of the invention is a warning device for the filler opening of a baling press with a press piston movable to and fro in a press housing, the said press piston dividing the press housing into a pressing space for the compression of the bale and a movement space for the movement of the press piston.

The invention has as its object the provision of a warning device for the filler opening of a baling press which prevents material to be compressed from being loaded by mistake via the opened filler door into the movement space of the press piston.

With this object in view it is provided that in the vicinity of the filler door of the press housing there is attached to the press piston elongated flexible means comprising one or more movable safety bands, preferably elastic, typically rubber, which cover partially the movement space of the press piston housing in the direction of the filler door.

An essential feature of the present invention is that whenever the press piston has traveled downwards and is located on the pressing face of the bale to be pressed in the vicinity of the filler door, a warning device consisting of one or more movable safety elements or bands has warning sections visible upon opening the filler door which makes it clear to the operator in a conspicuous manner that with the given position of the press piston, no material can be introduced via the filler opening into the baling press.

One end of one or several of the safety bands is firmly attached to the front side of the press piston which is disposed next to the filler door.

The other end portions of the one or more elongated elements or safety bands comprise a tension section or sections, which in the illustrated embodiment are arranged movably such that they are led around the upper side of the motion space over deflection means or guide rollers and is weight loaded or spring loaded, thus providing means for tensioning the elongated flexible elements or bands. During the compression stroke of the press piston, the safety bands are at the same time drawn down from the upper side of the motion space like a roller blind so that these cover at least partially the filler opening when the press piston is located on the press face of the bale being pressed.

If the safety element warning section is provided with a warning message (for example, "Throw no material in now"), the warning function is particularly clear. As soon as the press piston is again driven into its end position and rises from the press face of the bale to be pressed, the safety bands are again rolled in or taken up such that in the end resting position of the press piston when it contacts the upper limit of the movement space, they are not visible from the filler opening when the filler door is opened.

The use of elongated flexible elements or safety bands made of elastic, rubber or plastics material is simple and inexpensive. Movable shutters or foldable safety bands could be used so that the idea of the invention is not limited to safety bands, weight loaded or spring loaded or capable of being rolled up. It is only essential that in the vicinity of the filler door of the press housing one or more safety bands are disposed in the motion space, the said safety bands covering at least partially the filler opening of the press housing positioned too low in the housing for loading to be carried out.

A particularly effective arrangement occurs when the plane of the elongated flexible means or bands is approximately parallel to the plane of the filler door so that when the filler door is opened and the press piston is located on the pressing face of the bale, the warning inscription on the safety bands is evident to the user.

In a further embodiment of the present invention, it is arranged that the safety bands are disposed movably such that one end is attached to the press piston and their other free end is attached to a spring-loaded or weight-loaded winding apparatus. Such a winding apparatus would, for example, be a spring-wound roller or roller blind known in window coverings.

The only object of these different spring and weight loads on the free ends of the safety bands is the holding of the safety bands taut and also their shortening and moving along with the press piston as it is driven into its end resting position and the movement space become negligible in size. Therefore, instead of the spring or weight loading of the safety bands, a folding device or other device may be used as long as it conforms to these requirements.

PRIOR ART

Prior patents known to Applicant and pertinent, are as follows:

U.S. Pat. Nos. 3,274,922; 3,541,949; 3,614,925; 3,643,589; 3,762,312; 3,827,350, 3,831,513; and 4,041,856;

British Pat. Nos. 1,230,014 and 1,313,569;

French Pat. No. 1,493,286;

French Patent Specification Nos. 70.16511 (Publication No. 2,047,367);

West German published Application Documents Nos. 1,924,389 and 2,400,982.

BRIEF DESCRIPTION OF THE DRAWINGS

FIG. 1A is an enlarged partial view showing a pneumatic cylinder or gas compression spring utilized in one form of the invention;

DESCRIPTION OF THE PREFERRED EMBODIMENTS

Figure 1:
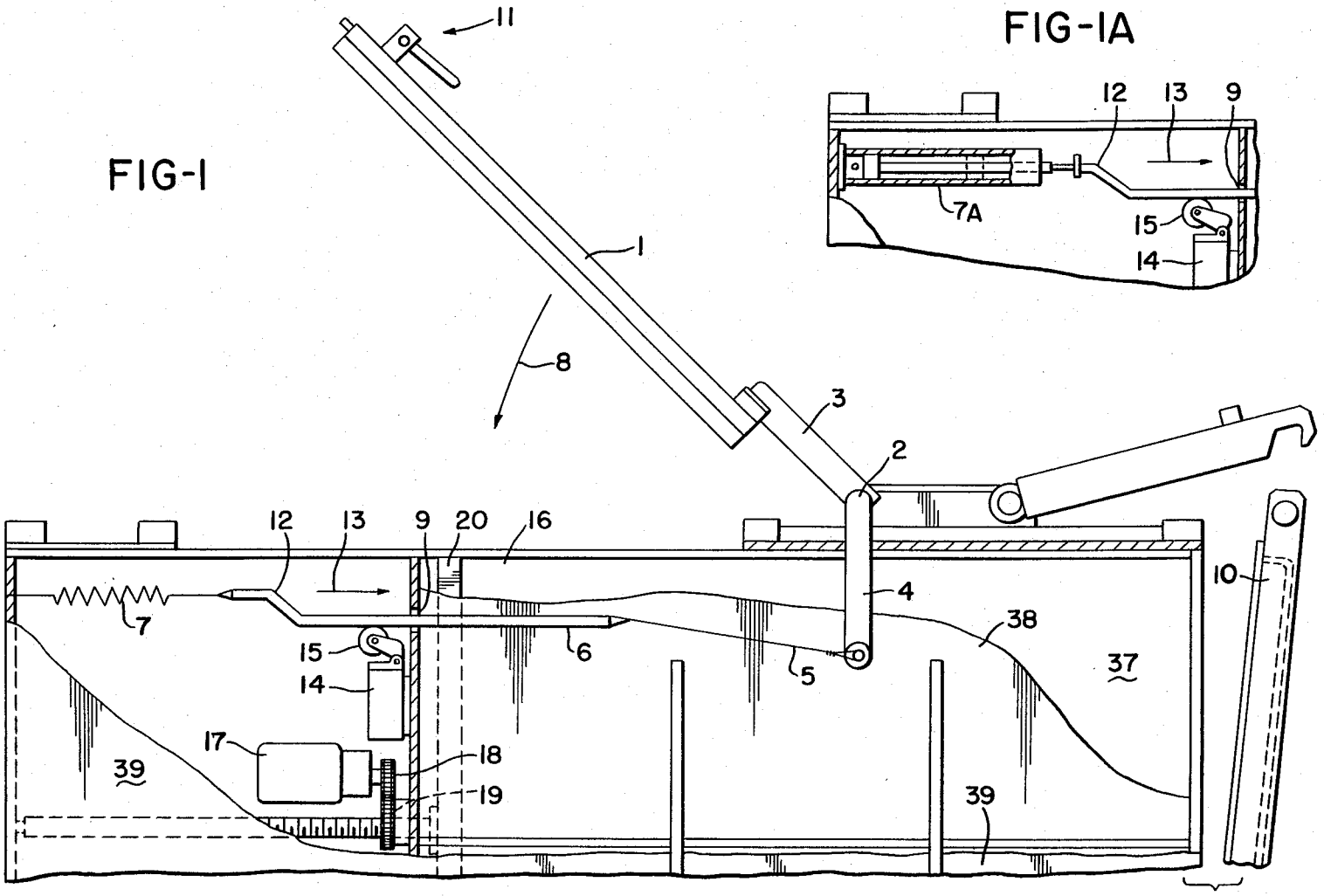
FIG. 1 shows diagrammatically in part representation the side view of a baling press with the parts essential to the invention.

Referring to FIG. 1, a pressing plate 20 disposed in press housing 16 is movable in the direction of arrow 13 by a drive system, including motor 17, sprocket and drive chain 18, a rotatable nut 19 and the lead screw or spindle shown, to compress the material to be baled against a press door 10 while the door is secured closed, this door being shown in FIG. 1 in a partially open position.

On the upper side of the press housing 16 is disposed a pivot 2 in which on both sides of the side walls of the press housing is hinged respectively an angle lever 3, 4 consisting of the upper lever part 3 and the lower lever part 4. The pivot 2 is therefore continuous over the whole width of the press housing 16 whereby on both sides respectively an angle lever 3, 4 may be hinged.

In another embodiment it is possible to provide the angle lever 3, 4 only on one side wall of the press housing.

On the upper end of the lever part 3 is hinged the filler lid 1. It is pivoted in the direction of the arrow 8 into its closed position wherein a locking device 11 engages with the press housing so that the filler lid 1 covers the filling opening (not shown) of the baling press.

On the other end of the lever part 4 is located a set of operating rods consisting of the rods 5 and a control bar 6. The rods 5 may be formed as a wire cable. The control bar 6 is mounted in a recess 9 in the side wall of the press housing 16 and has at its far end an angled portion 12 which defines the switch point for the switch 14. The extreme end of the control bar 6 is connected to a coiled spring 7 which in the embodiment serves as an energy store.

Upon pivoting of filler lid 1 in the direction of arrow 8 into its closed position, the control rod 6 is moved in the direction of arrow 13 to position angled portion 12 of the control rod above switch roller 15, whereupon the upwardly spring-urged sensing member or roller 15 pivots clockwise to operate electrical control switch 14 to turn on and energize and actuate the press drive. Upon the pivoting of the filler lid 1 in the direction opposite from the direction of arrow 8, clockwise as viewed, toward it open position, the control rod is moved leftward, as viewed, to depress switch roller 15 to turn off the switch and deenergize the press drive.

It can be seen that due to the length of the lever part 4, a long operating path in the direction of the arrow 13 results so that the small pivot angles of the filler lid 1 lead to a large displacement of the control rod 6. In this way the energy store 7 is pretensioned during the closing movement and can then give up its energy during the opening movement so that the filler lid opens substantially automatically by pivoting upwards in the opposite direction to the arrow 8.

The operating mechanism is preferably mounted on a wall of the press housing 16, as shown. The press housing comprises side walls 37, 38, the end walls shown and the upper and lower walls shown. It protects the switch 14 and other components from manipulation and contamination. A covering wall 39 extends across the entire side of the baling press.

It is, of course, possible to provide other energy stores corresponding to the coiled spring 7 on both side walls of the press housing. Instead of the traction spring used, a compression spring may be used.

FIG. 1A illustrates an energy store in the form of a pneumatic cylinder and piston arrangement or gas compression spring 7A.

Figure 2:
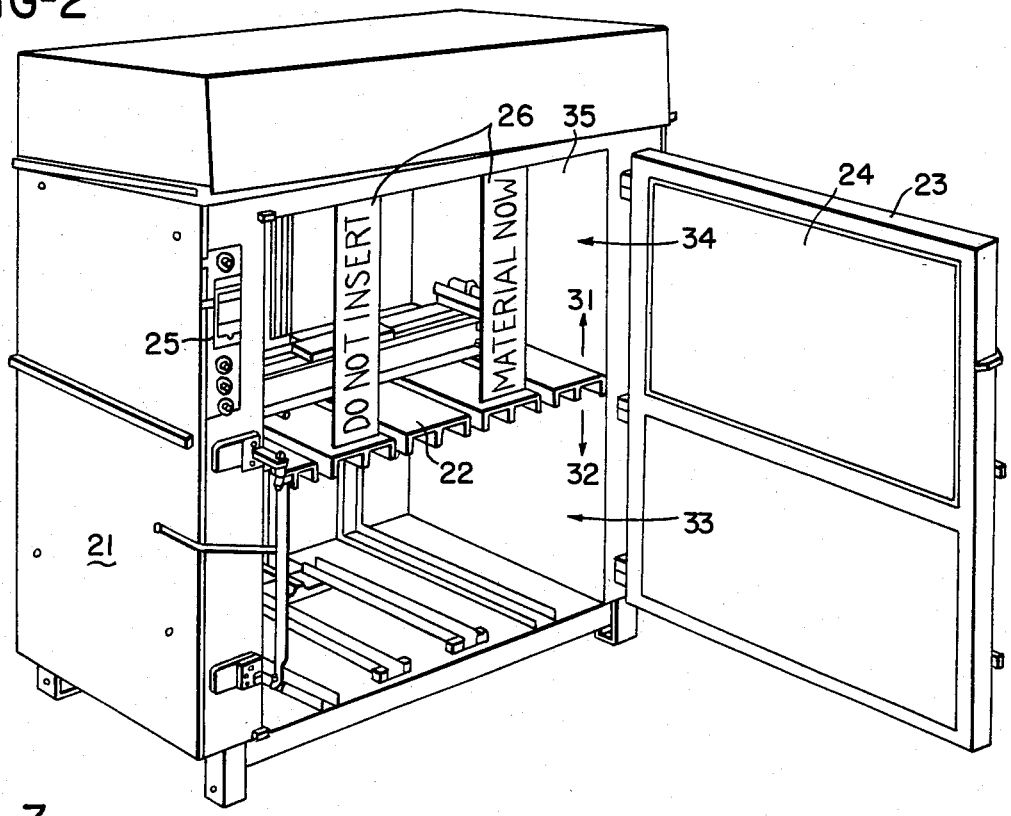
FIG. 2 is a perspective view of a baling press arrangement according to the invention, showing the utilization of elongated flexible elements or bands to provide safety warning.
Figure 3:
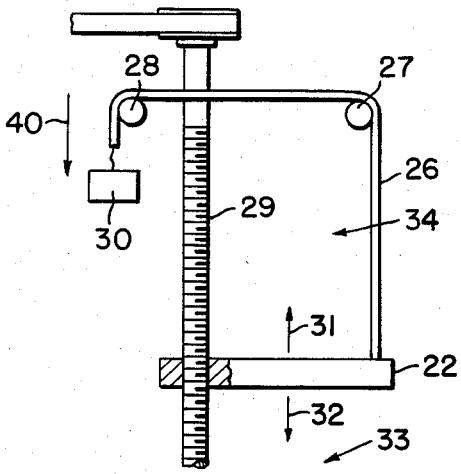
FIG. 3 is a diagrammatic side elevational view showing elongated safety elements or bands in association with tensioning means.

FIGS. 2 and 3 illustrate an embodiment of baling press according to the invention having a press housing 21 in which a press piston 22 is movable vertically.

The press piston 22 in the position shown divides off a press space 33 in which the bale is compressed against the bottom face of the press housing 21 from the movement space 34 above the press piston 22.

The front of the press housing 21 is covered by a press door 23 in which is disposed a filler door 24 capable of being opened separately to reveal a corresponding filler opening in the press housing.

In making a bale the press piston 22 is first driven upwards in the direction of the arrow 31, then with closed press door 23 the filler door 24 is opened so that material to be compressed can be loaded into the press housing 21. The material falls downwards in the direction of the arrow 32 onto the bottom of the press housing 21. The filler door 24 is then closed and the press piston 22 is driven downwards in the direction of the arrow 32 from its upper resting position 35. The material is thus compressed by the press piston 22 into the form of a bale. The press piston 22 is again driven upwards in the direction of the arrow 31 into the position 35 and the filler door 24 is again opened and again material to be compressed is loaded into the filler opening. The filler door 24 is then closed again and the press piston 22 is started from its position 35 and again runs downwards in the direction of the arrow 32 so that the newly filled material is compressed on the already partly formed bale.

A situation as in FIG. 2 may now result. Here the press piston 22 is still driven downwards and separates the press housing into a press space 33 and a movement space 34 disposed thereover.

If in this position with closed press door 23 the filler door 24 is opened, the operator cannot always see that the press piston 22 is in the position shown in FIG. 2. The operator may be misled into loading material through the filler opening of the press door 24 into the movement space 34 where the material is detrimentally compressed against the cover face of the press housing 21 when the press piston 22 is started upwards in the direction of the arrow 31.

In order to avoid this undesired operation of the baling press, the invention provides that elongated flexible means or safety bands 26 in the embodiment shown be provided to cover a limited area of the filler opening or movement space 34 of the press housing 21, thereby providing a clear safety warning to prevent an operator from inserting or loading material through the filler opening.

One or more elongated safety elements or bands 26 may be provided, but in the embodiment described there are two elongated flexible elements or safety bands spaced apart and parallel to one another. One end of each elastic safety band 26 is connected to the front side of the press piston 22. The other end portion or tension section 38 as shown in FIG. 3 is deflected or led over deflection means in the form of guide rollers 27, 28 mounted on the housing on the upper side of the movement space 34 inside the press housing 21, and may be loaded, for example, with a weight 30 which serves as tensioning means.

As shown in FIGS. 2 and 3, the press piston 22 is driven by a spring 29. The spindle 29 has an outer screw thread which engages by means of a corresponding inner screw thread on the press piston 22. With the drive of the spindle 29 by the belt drive shown, the press piston 22 may be moved upwards in the direction of the arrow 31, thereby enlarging the press space 33 and reducing the movement space 34.

Since a tension portion portion or end portion of each safety band 26 is loaded with a weight, when the press piston 22 travels upwards in the direction of the arrow 31, each safety band 26 is shortened because the end loaded with the weight 30 is also drawn downwards in the direction of the arrow 40.

Figure 5:
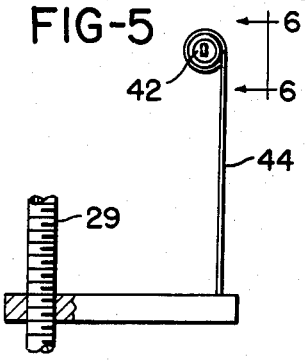
FIG. 5 is a diagrammatic side elevational view, similar to the view of FIG. 3, showing a modified form of the invention which utilizes tensioning means in the form of a spring-loaded roller.
Figure 6:
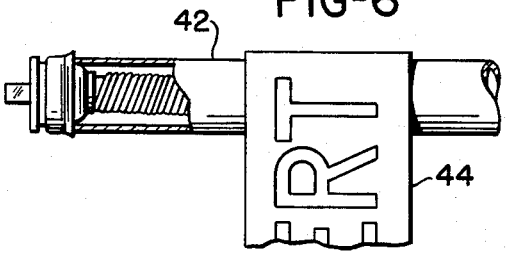
FIG. 6 is an enlarged partial view, taken at line 6—6 in FIG. 5.

Instead of the arrangement of a weight 30, a spring or a spring-loaded winding apparatus, as in a spring blind roller, may be used such an arrangement being illustrated in FIGS. 5 and 6, wherein a safety band 44 is shown wound on a spring roller 42.

It is also possible to fold or otherwise shorten the safety band when the press piston 22 is driven upwards in the direction of the arrow 31. Conversely, when the press piston 22 is moved downwards in the direction of the arrow 32, the safety bands 26 are drawn over the movement space 34 or its front side in the vicinity of the filler opening of the filler door 24. The course of movement of FIG. 3 is then reversed.

Figure 4:
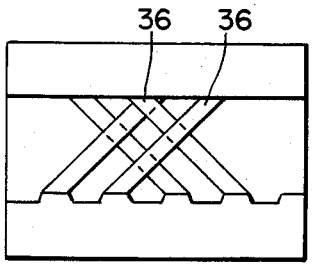
FIG. 4 shows an alternative arrangement or construction of safety bands.

FIG. 4 shows that crossed safety bands 36 may be used. Two or more pairs may lie arranged as a lattice and may be provided with stamps or characterizing colors of the manufacturers.

Thus there has been shown and described novel safety and warning devices for baling presses which fulfill all the objects and advantages sought therefor. Many changes, modifications, variations and other uses and applications of the subject invention will, however, become apparent to those skilled in the art after considering this specification and the accompanying drawings. All such changes, modifications, alterations and other uses and applications which do not depart from the spirit and scope of the invention are deemed to be covered by the invention which is limited only by the claims which follow.

I claim:

1. In a baling press having a housing defining a filler opening and a working space, and a press piston movable in the working space between a retracted position and a compressing position wherein a bale is compressed, said piston dividing the working space into a press space and a movement space, warning means comprising:

elongated flexible means attached to the piston, means mounted on the housing and engaging the elongated flexible means for extension thereof between an edge of said filler opening and the piston to provide warning to an operator against inserting material through the filler opening, and said engaging means comprising tensioning means engaging the elongated flexible means to maintain the elongated flexible means taut at all positions of the piston between said retracted and compressing positions.

2. A baling press warning device according to claim 1, wherein:

said engaging means mounted on the housing comprising deflecting means engaging the elongated flexible means.

3. A baling press warning device according to claim 1, wherein:

said elongated flexible means has a tensioning section engaging said tensioning means.

4. A baling press warning device according to claim 1, wherein:

the elongated flexible means has a warning section extending between the piston and an edge of the filler opening, said warning section bearing indicia warning an operator against inserting material through the filler opening.

5. A baling press warning device according to claim 4, wherein:

the elongated flexible means are configurated and sized to cover only a limited area of said filler opening to accommodate manual access through the filler opening.

6. A baling press warning device according to claim 1, wherein:

the tensioning means comprises at least one roller mounted on the housing about which the elongated flexible means extends, and further including weight means attached to the elongated flexible means.

7. A baling press warning device according to claim 1, wherein:

the tensioning means comprises spring-loading means.

8. A baling press warning device according to claim 7, wherein:

the tensioning means includes a roller about which the elongated flexible means is engaged, and said spring-loading means cooperates with the roller to provide a spring-wound roller.

9. A baling press warning device according to claim 1, wherein:

the elongated flexible means are configurated and sized to cover only a limited area of said filler opening to accommodate manual access through the filler opening.

10. A baling press warning device according to claim 1, wherein:

the elongated flexible means are fabricated of elastic material.

11. A baling press warning device according to claim 1, wherein:

the elongated flexible means comprise at least two elongated elements in crossing relation.

12. A baling press warning device according to claim 11, wherein:

the elongated flexible means comprise at least two pairs of crossed elements in a lattice arrangement.

13. A baling press warning device according to claim 11, wherein:

the elongated flexible means are safety bands.

14. A baling press warning device according to claim 1, wherein:

the elongated flexible means comprise at least two pairs of crossed elements in a lattice arrangement.

15. A baling press warning device according to claim 1, wherein:

the elongated flexible means comprise at least two elongated flexible elements in generally parallel relation.

16. A baling press warning device according to claim 15, wherein:

the elongated flexible means are safety bands.

17. In a baling press having a housing defining a filler opening and working space, and a press piston movable in the working space between a retracted position and a compressing position wherein a bale is compressed, said piston dividing the working space into a press space and a movement space, warning means comprising:

elongated elastic flexible means attached to the piston and connected with the housing for extension across said filler opening, said elongated elastic flexible means being taut at all positions between the retracted and compressing piston positions to provide warning to an operator against inserting material through the filler opening.

18. A baling press warning device according to claim 17, wherein:

the elongated flexible means are configurated and sized to cover only a limited area of said filler opening to accommodate manual access through the filler opening.

19. A baling press warning device according to claim 17, wherein:

the elongated flexible means comprise at least two elongated elements in crossing relation.

20. A baling press warning device according to claim 17, wherein:

the elongated flexible means are safety bands.

21. A baling press warning device according to claim 17, wherein:

the elongated flexible means includes a warning section extending between the piston and an edge of the filler opening, said warning section bearing indicia warning an operator against inserting material through the filler opening.

22. In a baling press having a housing defining a filler opening and a working space, and a press piston movable in the working space between a retracted position and a compressing position wherein a bale is compressed, said piston dividing the working space into a press space and a movement space, warning means comprising:

elongated flexible means attached to the piston and connected with the housing for extension across said filler opening, and tensioning means comprising at least a portion of said elongated flexible means for maintaining the elongated flexible means taut at all positions between its retracted and compressing positions to provide warning to an operator against inserting material through the filler opening.

23. A baling press warning device according to claim 22, wherein:

said elongated flexible means is elastic.

24. A baling press warning device according to claim 22, wherein:

the elongated flexible means are configurated and sized to cover only a limited area of said filler opening to accommodate manual access through the filler opening.

25. A baling press warning device according to claim 22, wherein:

the elongated flexible means comprise at least two elongated elements in crossing relation.

26. A baling press warning device according to claim 22, wherein:

the elongated flexible means includes a warning section extending between the piston and an edge of the filler opening, said warning section bearing indicia warning an operator against inserting material through the filler opening.

* * * * *